US007533726B2

(12) United States Patent
Gaskill

(10) Patent No.: US 7,533,726 B2
(45) Date of Patent: May 19, 2009

(54) METHOD OF INCREASING GAS WELL PRODUCTION

(76) Inventor: Robert A. Gaskill, P.O. Box 269, Muldrow, OK (US) 74948

( * ) Notice: Subject to any disclaimer, the term of this patent is extended or adjusted under 35 U.S.C. 154(b) by 159 days.

(21) Appl. No.: 11/181,398

(22) Filed: Jul. 14, 2005

(65) Prior Publication Data

US 2006/0011349 A1 Jan. 19, 2006

Related U.S. Application Data

(60) Provisional application No. 60/588,295, filed on Jul. 15, 2004.

(51) Int. Cl.
*E21B 43/32* (2006.01)

(52) U.S. Cl. ..... 166/311; 166/371

(58) Field of Classification Search ..... 166/256, 166/303, 261, 306, 305.1, 268, 265, 369, 166/244.1, 372, 266, 275, 270, 310, 311, 166/370, 371, 401, 402
See application file for complete search history.

(56) References Cited

U.S. PATENT DOCUMENTS

| | | | | | |
|---|---|---|---|---|---|
| 2,832,416 | A | | 4/1958 | Allen | |
| 3,524,504 | A | * | 8/1970 | Allen | 166/303 |
| 3,603,396 | A | | 9/1971 | Braun | |
| 3,720,263 | A | * | 3/1973 | Murphy et al. | 166/303 |
| 3,873,238 | A | * | 3/1975 | Elfarr | 417/54 |
| 4,410,041 | A | * | 10/1983 | Davies et al. | 166/300 |
| 5,052,490 | A | * | 10/1991 | Reed | 166/303 |
| 5,377,764 | A | * | 1/1995 | Jennings, Jr. | 166/372 |
| 5,501,279 | A | * | 3/1996 | Garg et al. | 166/372 |
| 5,871,048 | A | * | 2/1999 | Tokar et al. | 166/263 |
| 6,244,338 | B1 | * | 6/2001 | Mones | 166/245 |
| 6,672,392 | B2 | * | 1/2004 | Reitz | 166/372 |
| 6,745,815 | B1 | * | 6/2004 | Senyard et al. | 160/370 |
| 6,991,034 | B2 | * | 1/2006 | Wilde | 166/250.15 |
| 2004/0123987 | A1 | * | 7/2004 | Reitz | 166/370 |
| 2004/0177968 | A1 | * | 9/2004 | Ramachandran | 166/372 |

FOREIGN PATENT DOCUMENTS

WO WO03033865 * 4/2003

OTHER PUBLICATIONS www.google.com; general definitions/terminology.*

* cited by examiner

*Primary Examiner*—David J Bagnell
*Assistant Examiner*—David Andrews
(74) *Attorney, Agent, or Firm*—Dunlap Codding, P.C.

(57) ABSTRACT

A method of increasing the production of a formation gas from a well bore penetrating a gas producing formation wherein the formation gas has a water content that results in the formation of condensate water from the formation gas as the formation gas passes up the well bore to the surface so as cause the condensate water to accumulate at the bottom of the well bore and impede the flow of formation gas into the well bore from the gas producing formation. The method includes injecting a volume of a diluent gas having a water content less than the water content of the formation gas into the well bore at a pressure sufficient to cause the diluent gas to mix with the formation gas in the well bore and dilute the formation gas but at a pressure insufficient to cause the diluent gas to invade the gas producing subterranean zone to produce a production gas which has a water content that substantially prevents the formation and deposition of condensate water as the production gas passes to the surface.

1 Claim, 3 Drawing Sheets

METHOD OF INCREASING GAS WELL PRODUCTION

CROSS REFERENCE TO RELATED APPLICATIONS

This application claims benefit of U.S. Provisional Application No. 60/588,295, filed Jul. 15, 2004, which is incorporated herein by reference in its entirety.

BACKGROUND OF THE INVENTION

1. Field of the Invention

The present invention relates generally to increasing production of natural gas from natural gas reservoirs, and more particularly, but not by way of limitation, to a method for increasing gas well production from high water condensate content gas areas located within natural gas reservoirs.

2. Brief Description of the Related Art

It is only recently within the oil and gas industry that the concept of "stripper" gas well production has been recognized and addressed. A stripper gas well is typically a mature gas well that produces a limited amount of natural gas. The enhancement and retention of natural gas production has largely been secondary or even non-existent compared to newer technologies directed toward the development of advanced oil recovery techniques. However, natural gas has reached the forefront of valued energy commodities due to its continued and prolific increase in demand. Today, natural gas is an environmentally preferred fuel used to meet domestic power requirements. Efficient production and protection of established natural gas reserves is of paramount value and importance in light of national energy, security, and economic interests.

Currently, a detrimental phenomenon exists within "dry" gas areas. A dry gas area includes natural gas reservoirs having low water saturation levels and minute amounts or devoid of free water or liquid hydrocarbon production throughout its early life. However, during mature production years, methane rich natural gas reservoirs commence to show signs of fluid loading. In the past, operators have attempted to counteract fluid loading with mechanical adjustments to the well such as, for example, pumping units, plunger lifts, downsized tubulars, and down-hole separators and soap sticks. All of which require a fluid loaded environment to operate. While sometimes offering temporary relief, these mechanical adjustments have no permanent impact on the ill effects of fluid loading. As a result of an operator's inability to cope with this phenomenon, the individual well is usually prematurely abandoned resulting in a major loss of developed gas reserves.

The Arkoma basin, among others, offers a unique opportunity to review the performance of a typical dry marginal gas well. When individual test well data is sufficient, pressure-cumulative performance will indicate literally thousands of wells subject to excessive fluid build-up. As many as 10,000 wells in the Arkoma basin are threatened by this phenomenon which may result in an average estimated loss in gas reserves in excess of approximately 100 million cubic feet (MMCF) per well if not operationally confronted and corrected. Therefore, a potential loss of one trillion cubic feet of gas reserves may be lost and several billion dollars in lost income to operators and the respective states involved. The domestic impact of this poor performance could translate into significant loss to the nation's energy reserves since the Arkoma Basin may represent only 0.5% or less of total reserves.

The cause of this poor and deteriorating latter stage performance of a reservoir is the result of adverse gas-water phase behavior. Traditionally, the handling and processing of gas and its attendant fluids commences at the immediate wellhead delivery while little or no attention is directed to processing the gas prior to this point in the process. However, a great deal of physical transition occurs from the reservoir extremity, to near well-bore, to entry at down-hole perforations and ultimately through the tubular train to the surface wellhead. Behavioral effects are extremely damaging to production as gas approaches near well-bore. In particular, as gas approaches near well-bore, pressure-temperature reduction is severe causing the deposition of phase-water that is fresh in nature. Though phase-water deposited in this region may initially appear minute (for example, a few gallons per day) to an operator, over a prolonged period of time, the entire well-bore vicinity becomes re-saturated. For example, a reservoir with an initial water-saturation of 17% may re-saturate to a level of 80% in the near well-bore vicinity. The result of this re-saturation severely affects gas-to-water permeability (Kg/Kw) and restricts the rate of natural gas flow, proportionally. When gas enters the well-bore and vertical production tubular train on its way to the surface, a pressure-temperature drop occurs resulting in condensate water deposition. This condition will occur within the vertical flow train when minimum gas flow rates are not met for the existing tubular geometry. Because only a few gallons of water are deposited per day in this region, at this stage, a production problem is unrecognized.

Natural gas production problems are recognized only when fluid loading becomes critical enough to disrupt performance and gas production rate of the reservoir. That is, this critical fluid loading point is reached when the pressure and gas rate have diminished to minimum mist-flow rate conditions of a mature well and the water cannot successfully be lifted. Typically, an operator must mechanically lift the fluid in an attempt to maintain natural gas production.

Other methods of increasing gas well production by dry gas injection have been suggested where dry gas is injected into the formation to force the water into the formation a distance and to dry out the immediate well bore. However, after a period of time, the water will slowly bleed back into the vicinity of the well bore. These previous methods require high volumes of work gas availability which is not available to most low pressure, low volume gas wells.

To this end, a method is needed to reverse the adverse effect of fluid loading by utilizing the relationship of water-gas phase behavior in order to increase overall natural gas production of a gas well whereby condensate water is substantially removed from the flow train. Within this water-phase gas behavior relationship, pressure, temperature, and water-content (expressed as pounds/million cubic feet (#/MMCF)) are factors. Clearly, adjustments or manipulations to pressure and temperature profiles are extremely difficult, if not economically unsound; however, water-content control is feasible. It is to the aforementioned problems to which the present invention is directed.

BRIEF SUMMARY OF THE INVENTION

The present invention is directed to a method for increasing the production of a formation gas from a well bore penetrating a gas producing formation wherein the formation gas has a water content that results in the formation of condensate water from the formation gas as the formation gas passes up the well bore to the surface so as cause the condensate water to accumulate at the bottom of the well bore and impede the flow of formation gas into the well bore from the gas producing formation. The method includes injecting a volume of a diluent gas having a water content less than the water content of the formation gas into the well bore at a pressure sufficient to cause the diluent gas to mix with the formation gas in the well bore and dilute the formation gas but at a pressure insufficient to cause the diluent gas to invade the gas producing subterranean zone to produce a production gas which has a water content that substantially prevents the formation and deposition of condensate water as the production gas passes to the surface.

The objects, features and advantages of the present invention will become apparent from the following detailed description when read in conjunction with the accompanying drawings.

DETAILED DESCRIPTION OF THE INVENTION

To overcome the problems associated with gas wells having high water saturation levels creating a phenomenon known as "water loading" occurring within a natural gas well, dehydrated natural gas is injected and circulated into a natural gas well to dry out the flow train and thus increase natural gas production of the gas well. The volume of dehydrated gas that may be injected into the well may vary accordingly to various predetermined well conditions.

Sufficient quantities of dehydrated gas are injected and circulated into the well at a minimum pressure (friction pressure) so as to control and remove the concentration of the water restricting gas flow from the well. The gas injected into the well preferably will come from the production of the well. However, it will be appreciated that the injection gas may come from other sources.

In a preferred method, the present invention contemplates a cyclical injection whereby dry gas is injected into and circulated about the well at a minimum pressure so as to dilute and convert high water-content gas, at bottom hole conditions, to meet the well-head surface produced gas effluent water content at surface pressure and temperature conditions thereby denying the formation and deposition of phase-water. The newly converted natural gas retrieved from the well bore may be re-dehydrated and re-injected into the same well bore thereby creating a cyclical effect with the remainder used as sales gas.

Figure 1:
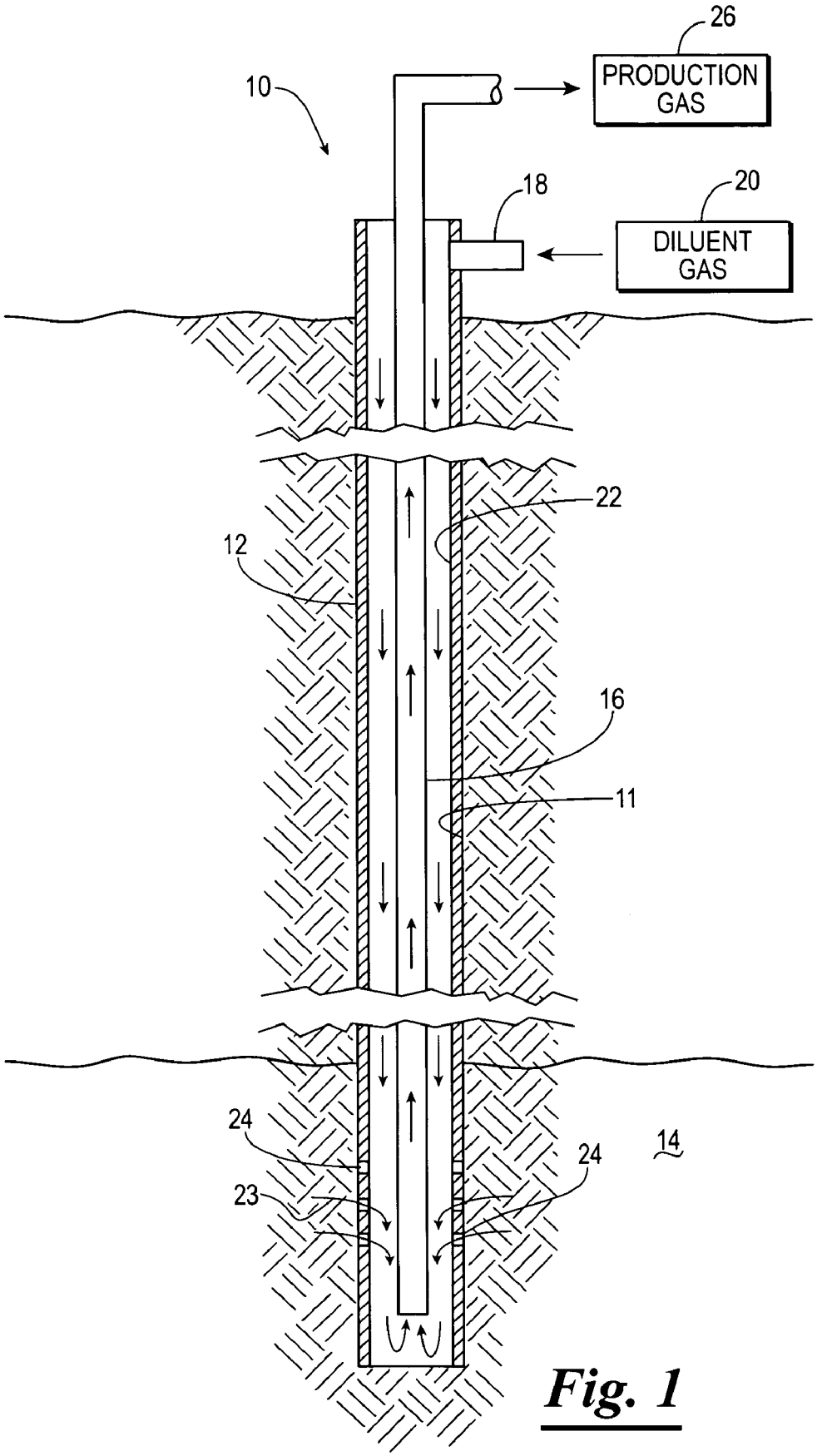
FIG. 1 is a schematic representation of a well bore penetrating a gas producing subterranean formation illustrating a diluent gas being injected into the well bore in accordance with the present invention.

Referring now to the drawings, and more specifically to FIG. 1, a gas production well 10 in accordance with the present invention is illustrated. The gas production well 10 includes a well bore 11 lined with a casing 12 that extends down to a gas producing subterranean formation 14. A production tubing 16 is disposed in the casing 12.

The casing 12 includes an inlet 18 located above-ground for inputting a predetermined volume of a diluent gas 20. The diluent gas 20 may be dehydrated natural gas. In a preferred method, the diluent gas 20 is injected into an annulus 22 via the inlet 18 at a pressure sufficient to cause the diluent gas 20 to mix with a formation gas (represented by arrows 23) which has entered the well bore 11 via perforations 24 formed in the casing 12. The diluent gas 20 mixing with the formation gas 23 in the well bore 11 cause the formation gas 23 to be diluted so as to produce a production gas 26 which has a water content that substantially prevents the formation and deposition of condensate water as the production gas 24 passes to the surface. The diluent gas 20 is preferably injected at a minimum pressure insufficient to cause the diluent gas 20 to invade the gas producing subterranean formation 14 and insufficient to push liquid through the well bore toward the surface.

Upon creation of the production gas 26, the production gas 26 is recovered from the well bore 11 via the tubing 16.

By diluting the water content of the high water-content natural gas to meet the dehydrated natural gas water-content at surface pressure and temperature conditions, the formation and deposition of phase-water is denied and the damaging effects of near well-bore water saturation previously induced by water loading may possibly be restored to original flow conditions. A partial restoration of relative permeability (Kg/Kw) flow conditions may serve to increase the gas flow rate to further contribute to production efficiency and gas reserve retention.

Further, the present invention may also dry out the near and immediate well-bore vicinities thereby reversing the phase behavioral effects of high water deposition and restoring the region to original conditions. The association of other corrosive natural gas with free phase water may also have harmful and costly corrosive effects on the subsurface tubulars, such as the casing 12 and tubing 14. Drying out these vertical tubular columns denies detrimental and costly effects of any down-hole associated carbon dioxide or hydrogen sulfide gas (present in many basins) thereby further eliminating down-hole tubular corrosion from that source.

Figure 2:
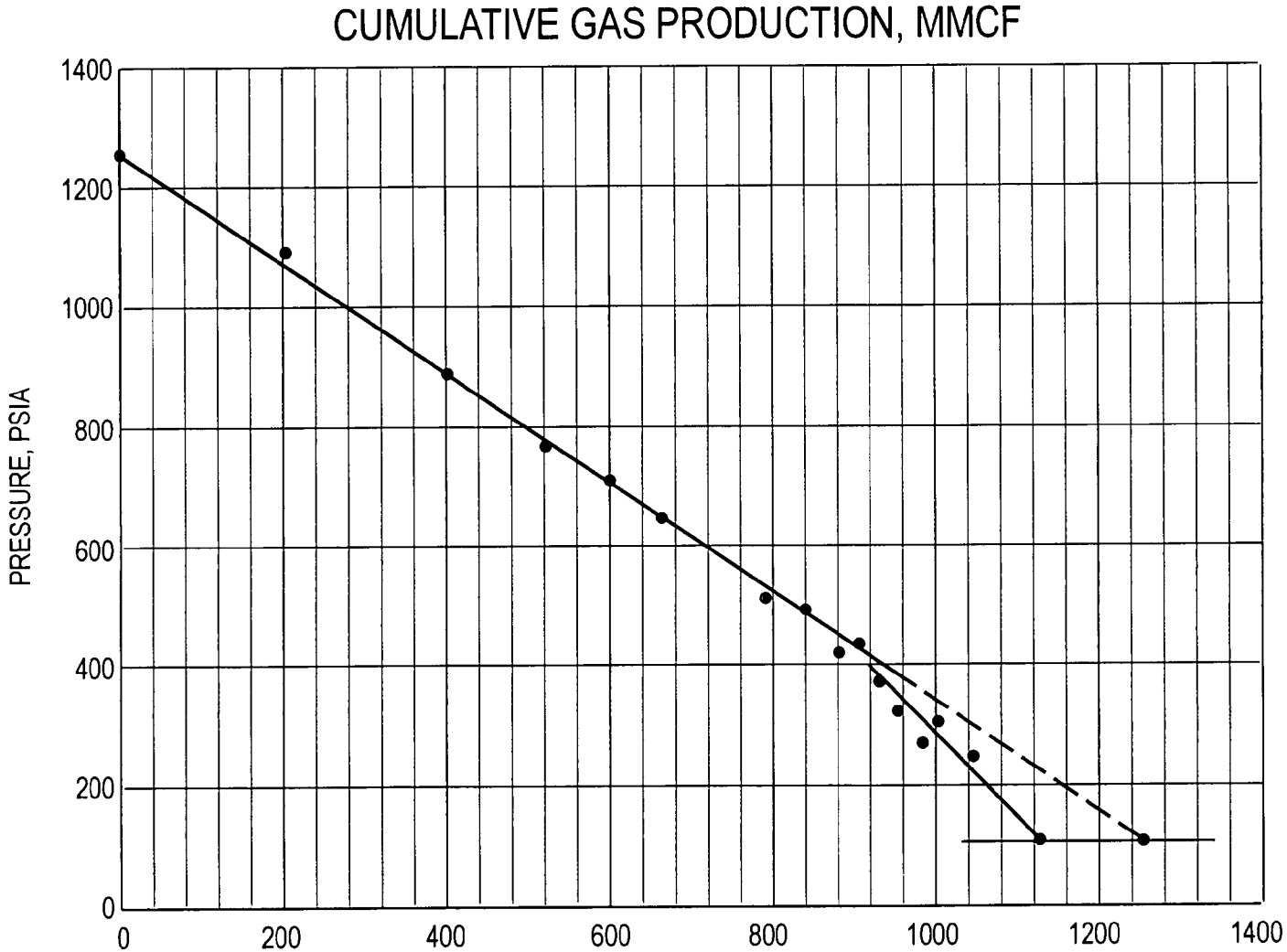
FIG. 2 is a graphic representation of cumulative gas production of a well experiencing effects of fluid loading.

FIG. 2 represents a typical performance of an individual well that identifies and quantifies the detrimental aspect of mature life fluid loading. In this example, the well first shows signs of water loading after recovery of about 900 MMCF of gas production. At this juncture, a projection of 1200 MMCF could be extrapolated as an ultimate recovery to 100 psia abandonment pressure. The well was capable of about 300 millions of cubic feet per day, a rate that is below the minimum mist flow lift requirements. Additional performance indicates that, as the condition becomes more accelerated and severe, the ultimate recovery is far less. If not corrected, the continued maintenance of this well in this manner results in a loss of gas reserves is estimated to be about 130 MMCF.

Figure 3:
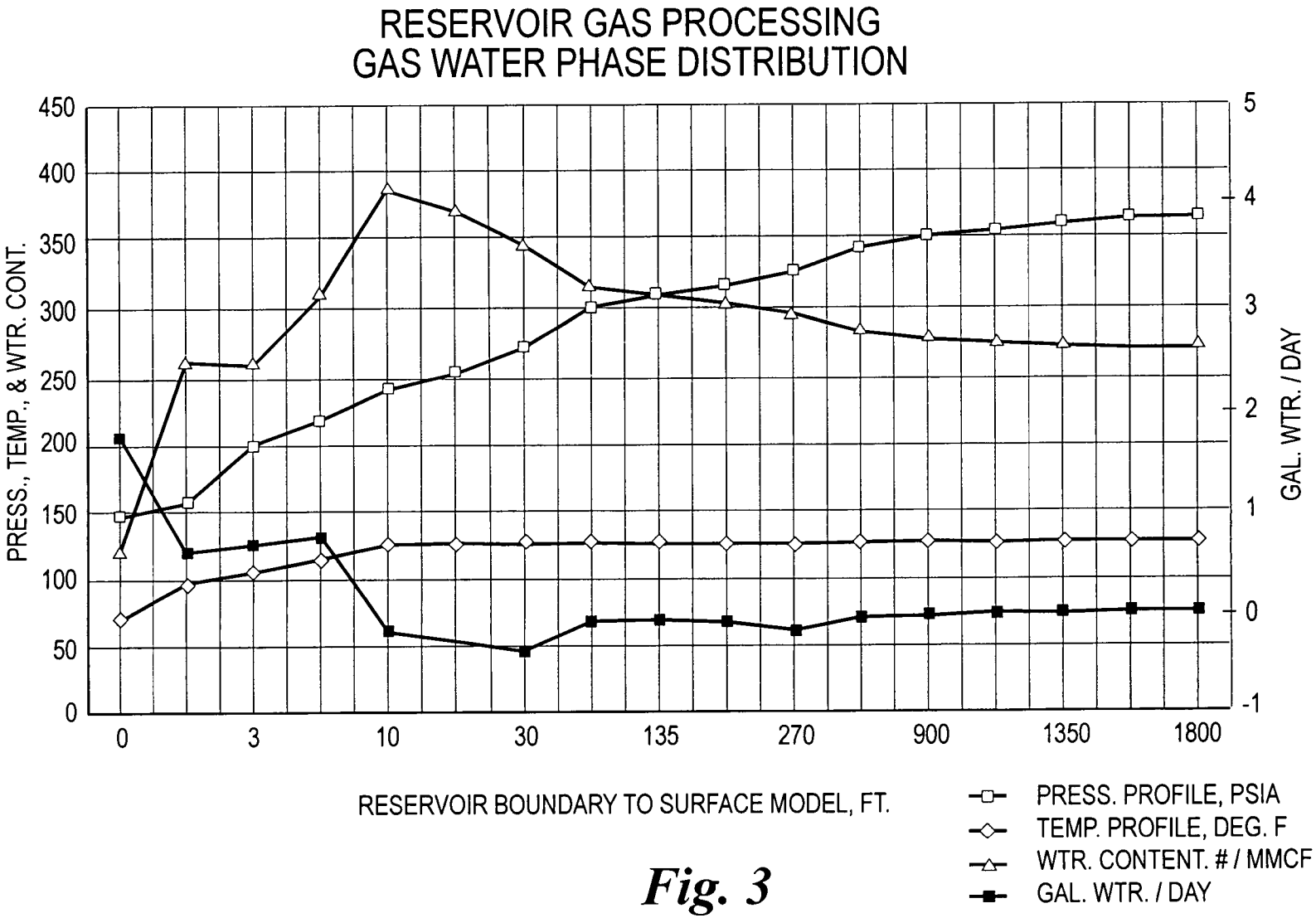
FIG. 3 is a graphical representation of gas-water phase distribution behavior portraying pressure, temperature, and water content from a reservoir extremity to a surface wellhead delivery point.

A reservoir to wellhead analysis was conducted to demonstrate where the major effects of gas water phase behavior occur. FIG. 3 is presented to graphically illustrate this condition.

Table 1 is a reservoir to wellhead model representing a well located in the Arkoma basin. This table represents how and where the effects of gas-water phase behavior occur and are based on radial flow depletion geometry. This model will require adjustment to accommodate a fractured, lateral led, or other completion or reserve configurations.

TABLE 1

| GAS-WATER PHASE DISTRIBUTION ANALYSIS WELL DATE: NO NAME NO. 1 | |
|---|---|
| RESERVOIR PARAMETERS: | |
| POROSITY | 0.12 |
| RESERVOIR WTR. SAT. | 0.22 |
| K-CURRENT EFF. PERM., MD* | 0.37 |
| P*-BOUNDARY PRESS., PSIA | 365.0 |
| D-DEPTH RESERVOIR., FT | 3365.0 |
| BHT-DEG. F. | 125.0 |
| H-RES. THICKNESS, FT | 20.0 |
| RW-DRAIN. RADIUS., FT | 1800.0 |
| AREAL EXTENT RES., ACRES | 234.0 |
| REM. DEVEL. GAS RESERVES, MMCF | 325.0 |
| FLOW RATE DATA: | |
| Q - FLOW RATE, MCFPD | 101.0 |
| Pwf-BH FLOW PRESS., PSIA | 156.0 |
| Tsur, DEG. F. | 70.0 |
| U -GAS VISC., CP | 0.0135 |
| Z -DEVIATION FACTOR | 0.95 |
| CRITICAL WTR. SAT. | 0.45 |
| OD. PROD. TBG. SIZE, in | 2.375 |
| ID. PROD. TBG. SIZE, in | 1.995 |
| ID. PROD. CSG. SIZE, in | 4.950 |
| ANALYSIS RESULTS AND EFFECT: | |
| Qmin., Tbg., MCFPD | 436.0 |
| Qmin. Csg. Ann., MCFPD | 2069.0 |
| EST. Kwb-ORIG. WELLBORE PERM., MD | 0.90 |
| EST. UNIMPAIRED RATE, MCFPD | 226.0 |
| REM. OPER. GAS RESERVES, MMCF | 195.0 |
| EST. RESERVE LOSS, MMCF DUE TO INABILITY TO HANDLE WTR. LOADING | 130.0 |
| REQUIREMENTS FOR DILUENT GAS LIFT OPTION: | |
| WATER CONTENT DILUENT GAS: #/MMCF | 33.00 |
| EST. DEHY DILUENT GAS REQUIRED TO DRY SYSTEM TO PREVENT FLUID BUILDUP IN MCFPD | 293.0 |
| TOTAL CIRCULATED VOL. MCFPD | 394.0 |
| SURFACE INJECT. PRESS., psia | 156.0 |
| FRICTION PRESS. DROP, psia | 10.0 |

*(DUE TO INCREASED OPERATING WELLBORE SW)
(RADIAL FLOW MODEL PRESENTATION)

Table 1 presumes the maximum reservoir water saturation to occur near well-bore to be 80%. A critical water saturation of 45% is also utilized allowing free phase water production in the near well-bore region. In this model, to represent gas located in the Arkoma basin, a specific gas gravity of 0.57 was used.

Table 1 indicates that, under pressure and flow restraints at the time of the test, the existence of a water saturation impaired effective permeability of 0.37 md to be operative. The reduction is due to the effects of near well-bore region re-saturation on relative permeability (Kg/Kw) resulting in a rate impairment of 55%. It would imply, that if the near well-bore vicinity could be restored to original conditions, the gas rate of flow for this well may increase from 101 millions of cubic feet per day to 226 millions of cubic feet per day.

Table 1 shows a gas-water phase distribution analysis when the volume of dehydrated diluent work gas is 33 pounds of water per million cubic feet. The injection pressure required to mix and dry out the down-hole production gas and transport all water fluids to the surface for handling is shown to 293 MMCFPD. By this analysis, approximately 130 MMCF of developed gas reserves are retained for future production. Such gas-water condensate equilibrium calculations are well known to one of ordinary skill in the art and described in *Petroleum Engineering Handbook* (1997), pages 25-11 to 25-13, the contents of which are hereby incorporated herein by reference.

The mechanical and economic advantages of this novel method of increasing gas well production are readily apparent. Dehydration and compression equipment necessary to conduct the present invention may be made available from a central location to a well site or be placed at an individual well site.

The present invention has been described herein with respect to particular embodiments and aspects thereof. Changes may be made in the steps or the sequence of steps of the methods described herein without departing from the spirit and scope of the invention as described above.

What is claimed is:

1. A method for increasing the production of a formation gas from a well bore penetrating a gas producing subterranean formation wherein the formation gas has a water content that results in the formation of condensate water from the formation gas as the formation gas passes up the well bore to the surface so as to cause the condensate water to accumulate at the bottom of the well bore and impede the flow of formation gas into the well bore from the gas producing subterranean formation, the method comprising:

injecting a volume of a diluent gas having a water content less than the water content of the formation gas into the well bore at a pressure insufficient to cause the diluent gas to invade the gas producing formation and insufficient to push liquid through the well bore, toward the surface yet sufficient to cause the diluent gas to mix with and dilute the formation gas in the well bore adjacent the gas producing formation at bottom hole pressure and temperature conditions to produce a production gas that has a water content in equilibrium at surface pressure and temperature conditions to prevent the formation and deposition of condensate water as the production gas passes to the surface; and recovering the production gas at the surface.

* * * * *

UNITED STATES PATENT AND TRADEMARK OFFICE

CERTIFICATE OF CORRECTION

PATENT NO. : 7,533,726 B2
APPLICATION NO. : 11/181398
DATED : May 19, 2009
INVENTOR(S) : Robert A. Gaskill It is certified that error appears in the above-identified patent and that said Letters Patent is hereby corrected as shown below:

In the Drawings, Sheet 3 of 3: Replace FIG. 3 with the following FIG. 3:

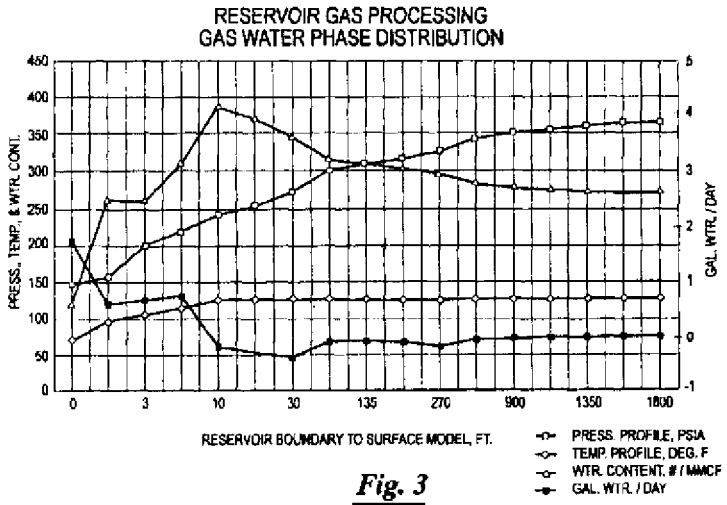

*Fig. 3*

Signed and Sealed this

Thirtieth Day of June, 2009

John Doll

JOHN DOLL
*Acting Director of the United States Patent and Trademark Office*